United States Patent [19]

Jurcak

[11] 4,348,788

[45] Sep. 14, 1982

[54] OYSTER OPENER

[76] Inventor: Frank C. Jurcak, P.O. Box 124, Lostant, Ill. 61334

[21] Appl. No.: 151,423

[22] Filed: May 19, 1980

[51] Int. Cl.[3] ..... A22C 29/04

[52] U.S. Cl. ..... 17/76

[58] Field of Search ..... 17/76, 74, 75

[56] References Cited

U.S. PATENT DOCUMENTS

| | | | |
|---|---|---|---|
| 210,032 | 11/1878 | Heimlich | 17/76 |
| 247,445 | 9/1881 | Ward | 17/76 |
| 332,403 | 12/1885 | Leduc | 17/76 |
| 2,136,816 | 11/1938 | Frazier | 17/76 |
| 2,747,220 | 5/1956 | Thompson | 17/76 |
| 3,548,450 | 12/1970 | Helmer | 17/76 |

FOREIGN PATENT DOCUMENTS

| | | | |
|---|---|---|---|
| 384044 | 12/1932 | United Kingdom | 17/76 |

*Primary Examiner*—Willie G. Abercrombie

[57] ABSTRACT

A base is provided including a centrally upwardly facing roughened surface portion and the base includes a raised mounting point horizontally spaced to one side of the roughened surface portion. An elongated lever has one end pivotally anchored to the mounting point for swinging movement of the free end of the lever in an upright plane containing the mounting point and the roughened surface portion. The other end of the lever defines a handle portion and an intermediate portion of the lever is disposed over the roughened surface portion and includes a depending downwardly tapered wedge member supported therefrom including a lower apex edge extending transversely of the lever. When the handle portion of the lever is generally horizontally disposed, the lower end of the wedge member is generally horizontally aligned with the mounting point and spaced generally (X) distance above the roughened surface portion and 2(X) from the mounting point with the effective vertical extent of the wedge member from the intermediate lever portion downwardly to the lower tip of the wedge member being generally $1\frac{1}{2}$(X). The transverse lower apex edge of the wedge and its spacing relative to the lever intermediate portion, the lever mounting point and the roughened surface portion of the base assists in the use of the lever and wedge member to open a clam or oyster with minimum effort and increased safety.

4 Claims, 6 Drawing Figures

OYSTER OPENER

BACKGROUND OF THE INVENTION

Various forms of manually operable devices heretofore have been provided for opening claims and oysters and include base portions relative to which wedge supporting lever arms are pivotally mounted. However, although these previously known devices are operative to open clams and oysters, for various reasons they are not as effective as they might be in performing the functions for which they have been specifically designed. Accordingly, a need exists for an improved oyster or clam opener of the manually actuatable type. Examples of oyster and clam openers including some of the general structural and operational features of the instant invention are disclosed in U.S. Pat. Nos. 34,495, 189,966, 210,032, 2,000,075 and 2,747,220.

BRIEF DESCRIPTION OF THE INVENTION

The clam and oyster opener of the instant invention has been specifically designed to provide a manually actuatable wedge equipped levertype apparatus which has been specifically designed to enable an oyster or clam shell to be readily opened and which includes relative dimensions and orientation of the relatively movable components thereof which have been scientifically developed in order to provide an apparatus which may be readily actuated, even by inexperienced persons, for opening clams and oysters.

The main object of this invention is to provide a clam or oyster opener which may be utilized efficiently to open clam and oyster shells.

Another object of this invention is to provide an opener in accordance with the preceding object and constructed in a manner whereby it may be utilized on substantially any suitable horizontal surface.

Yet another object of this invention is to provide an opener including structure enabling the shell to be opened to be securely stationarily supported from the opener for actuation thereupon by the lever supported wedge member thereof.

Another object of this invention is to provide an opener which will enable clams and oyster shells to be readily opened with little effort and without unnecessarily fragmenting the oyster and the clam shells being opened.

A final object of this invention to be specifically enumerated herein is to provide a clam and oyster shell opener constructed in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
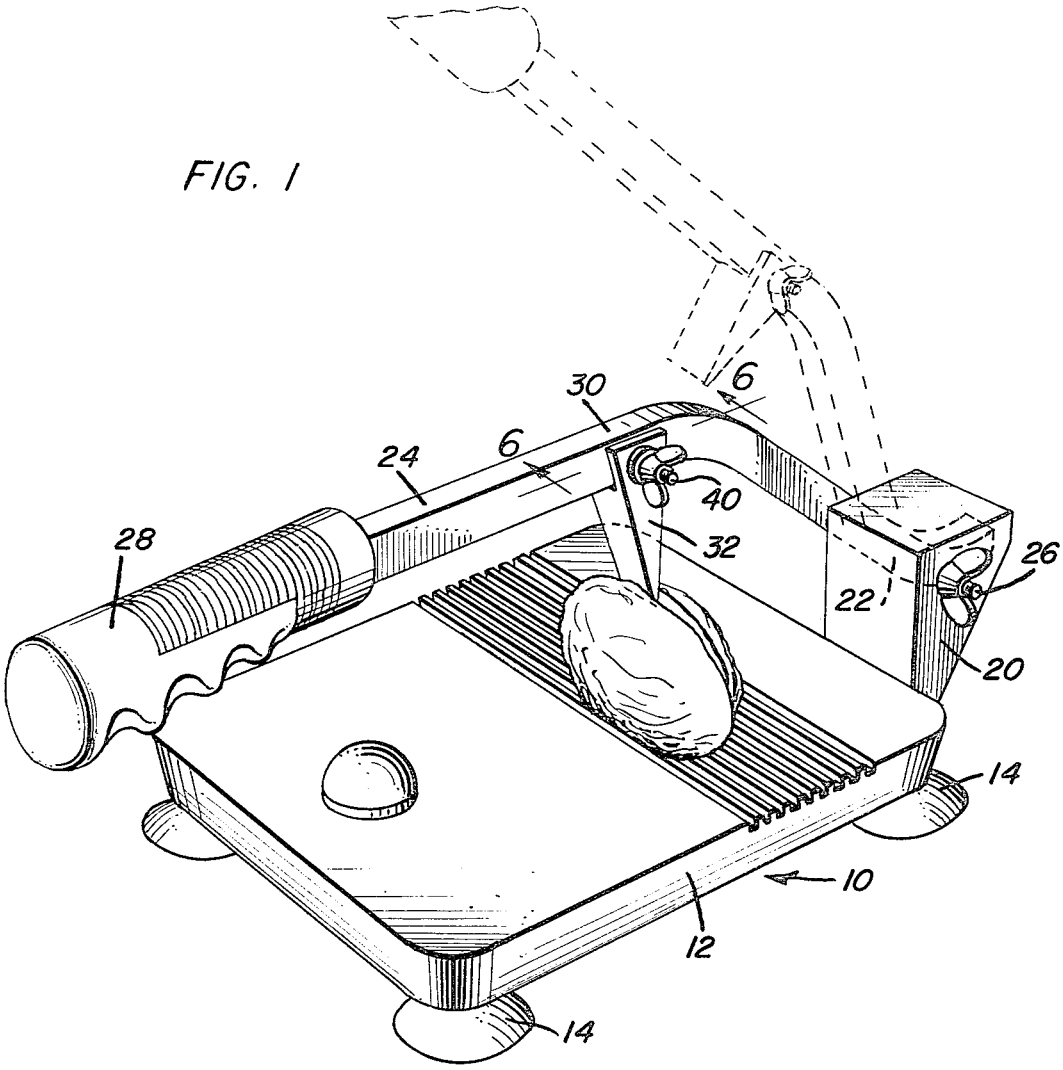
FIG. 1 is a perspective view of the opener of the instant invention in operative association with a small oyster shell to be opened.
Figure 2:
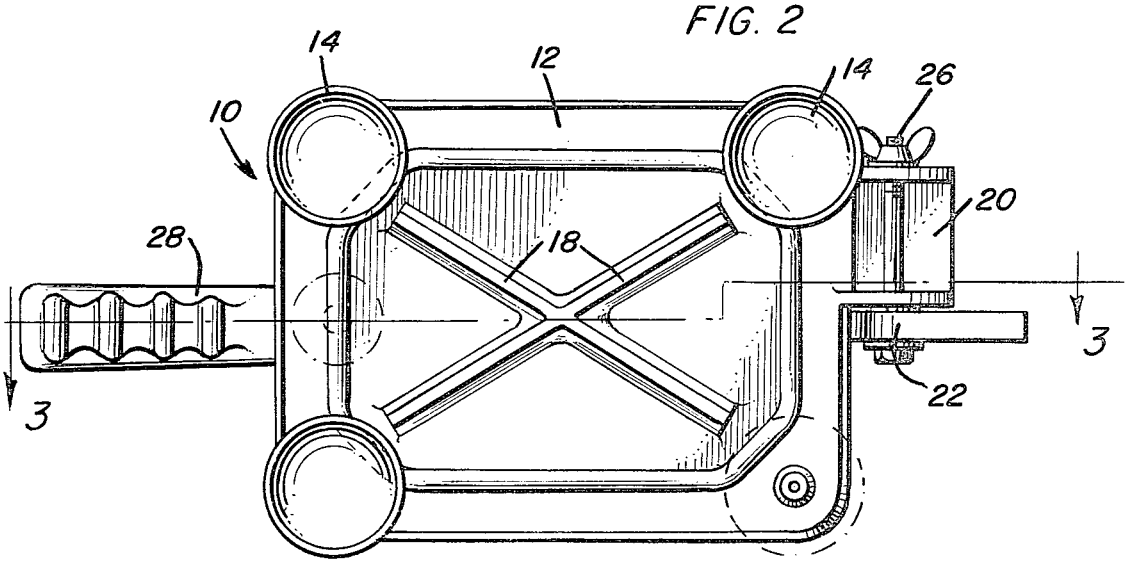
FIG. 2 is a bottom plan view of the opener on somewhat of a reduced scale and with one of the supporting feet of the opener removed.

Referring now more specifically to the drawings, the numeral 10 generally designates the opener of the instant invention. The opener 10 includes a horizontal base 12 of generally rectangular configuration and including four-corner dependingly supported suction cup-type feet 14 for support from a suitable horizontal support surface 16. The base 12 may be cast in one piece and includes underside cross bracing 18.

One corner portion of the base 12 includes an upwardly projecting mount 20 and one end portion 22 of an elongated lever 24 is pivotally supported from the mount 20 through the utilization of a horizontal pivot fastener 26 passed horizontally through the end portion 22 in the mount 20. The other or opposite end of the lever 24 has a vinyl hand grip 28 mounted thereon and an intermediate portion 30 of the lever 24 supports a depending and downwardly tapering wedge member 32 therefrom. The upper end of the wedge member is bifurcated and defines a pair of opposite side apertured mounting ears or furcations 34 and the underside of the intermediate portion 30 of the lever 24 includes a downwardly opening transverse notch 36 which seatingly receives the bottom 38 of the bifurcated upper end portion of the wedge member 32 therein. A removable threaded fastener 40 is secured through a transverse bore 42 formed in the intermediate portion 30 of the lever 24 and the apertured mounting ears or furcations 34 of the wedge member 32.

Figure 3:
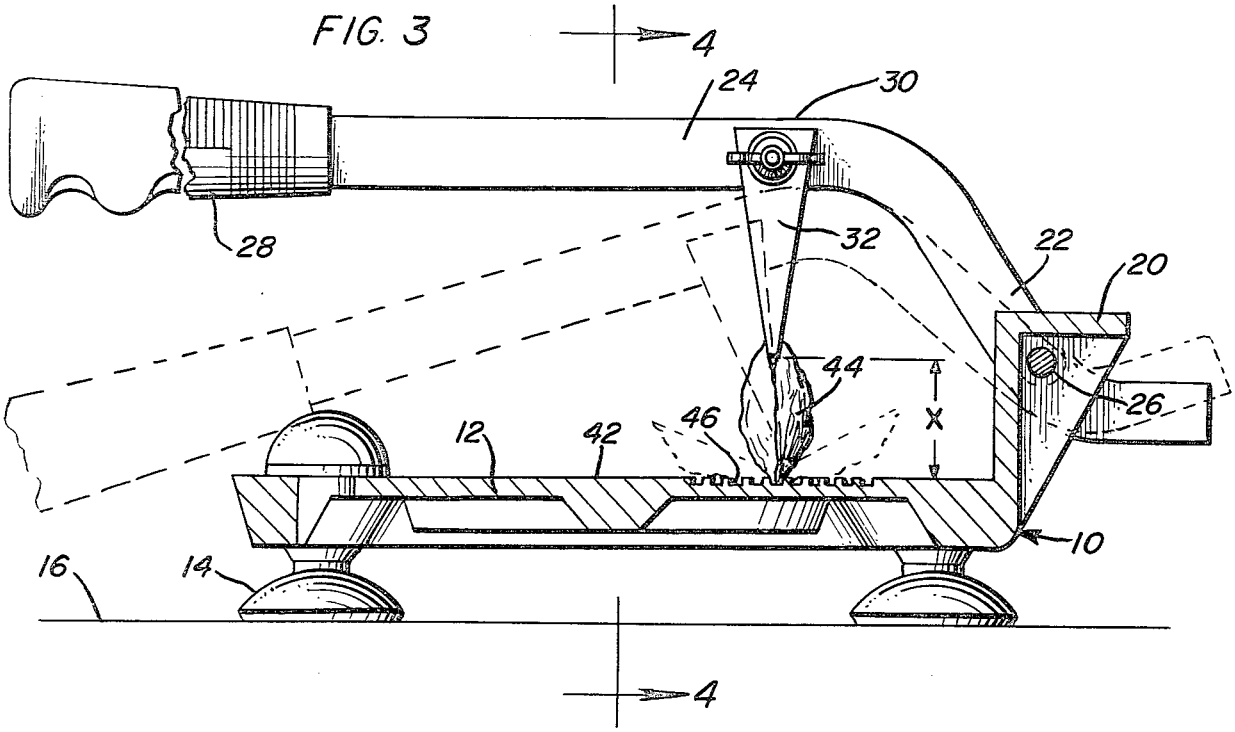
FIG. 3 is an enlarged fragmentary vertical sectional view taken substantially upon the plane indicated by the section line 3—3 of FIG. 2 and with an alternate downwardly displaced position of the lever of the opener illustrated in phantom lines.
Figure 4:
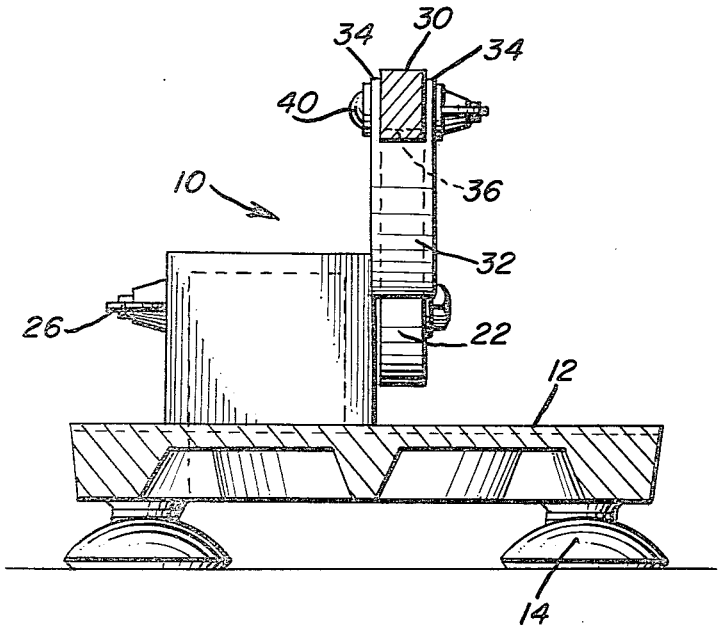
FIG. 4 is a transverse vertical sectional view taken substantially upon the plane indicated by the section line 4—4 of FIG. 3.
Figure 5:
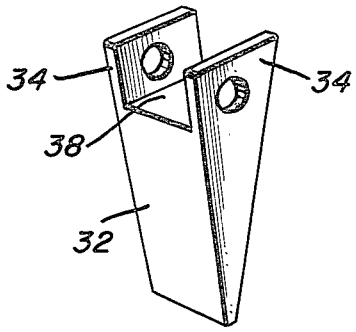
FIG. 5 is a perspective view of the wedge member portion of the opener.
Figure 6:
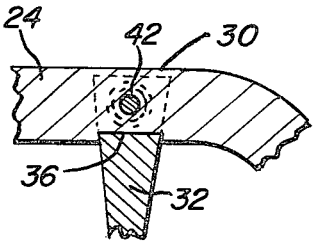
FIG. 6 is a fragmentary enlarged vertical sectional view taken substantially upon the plane indicated by the section line 6—6 of FIG. 1.

From FIG. 3 of the drawings, it may be seen that the end portion 22 is downwardly displaced relative to the remainder of the lever 34 including the intermediate portion 30 and the hand grip 28. Further, it will be noted that when the intermediate portion 30 and hand grip 28 are substantially horizontally disposed, the lower end of the wedge member 32 is generally horizontally aligned with the pivot fastener 36. Also, the spacing of the lower end of the wedge member 32 above the upper surface 42 of the base 12 is approximately 1(X), see FIG. 1, the horizontal spacing between the lower end of the wedge member 32 and the pivot fastener 26 is approximately 2(X) and the effective vertical extent of the wedge member 32 is approximately $1\frac{1}{2}$(X).

The above general proportions are reasonably critical to proper operation of the opener 10. It will be noted that when a small oyster shell 44 is disposed on the upper surface 42 and engaged by the lower end of the wedge member 32, the lever 42 is generally horizontally disposed. Further, when a larger or conventional size oyster shell is disposed on the surface 42 beneath the wedge member 32, the intermediate portion 30 and hand grip 28 of the lever 24 are generally upwardly inclined approximately 30°. However, inasmuch as the pivot fastener 26 is spaced approximately at the level of the lower end of the wedge member 32 when the intermediate portion 30 and hand grip 28 are horizontally disposed, downward movement of the lever during the process of opening an ordinary size or small size oyster sheel enables the lower end of the wedge member 32 to move generally in a straight downward direction.

The upper surface 42 of the base 12 includes longitudinally spaced and transversely extending side-by-side upwardly opening grooves 46 formed therein and the grooves 46 serve to maintain the lower portion of the shell 44 in position on the upper surface 42 against shifting relative thereto during the opening process of the shell 44. Because of the above disclosed relative dimensions and spatial relationships of the components 26, 30, 32 and 42, the opener 10 may be utilized effectively to exert a substantially vertical downward force on an oyster shell to be opened, independent of the size of the oyster shell being opened. Also, inasmuch as the intermediate portion 30 of the lever 24 includes the downwardly opening notch 36 against which the bottom 38 of the upper bifurcated end of the wedge member 32 is seated, the wedge member 32 is securely removably fastened to the lever 24 by means of a single removable fastener 40 in an effective manner.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An oyster opener including a base defining an upwardly facing roughened surface portion, said base including a raised mounting point horizontally spaced to one side of said roughened surface portion, an elongated lever having one end pivotally anchored to said mounting point for swinging movement in an upright plane containing said mounting point and the roughened surface portion and about an axis disposed transverse to said one lever end, an intermediate portion of the said lever being disposed over said roughened portion and including a depending downwardly tapered wedge member supported therefrom for movement toward and away from said roughened surface portion upon similar swinging of said intermediate portion, the other end of said lever defining a handle portion, said wedge member including a generally horizontal lower apex edge extending transverse of said lever and generally paralleling said axis, said roughened surface portion being defined by a plurality of upwardly opening side-by-side grooves formed in the upper surface of said base and disposed generally normal to said plane, said wedge member extending vertically downwardly when said other end portion of said lever is generally horizontally disposed, the lower end of said wedge member being generally horizontally aligned with said mounting point when said other end portion of said lever is generally horizontally disposed, the lower end of said wedge member being spaced generally (X) distance above said surface portion when said other end of said lever is horizontally disposed, the distance between the lower end of said wedge member and said mounting point being generally 2(X), and the effective vertical extent of said wedge member from the lower end thereof to said intermediate portion of said lever being generally $1\frac{1}{2}$(X).

2. The combination of claim 1 wherein the upper end of said wedge member is bifurcated and defines a transverse upwardly opening groove formed therein in which said intermediate portion is seatingly received.

3. The combination of claim 2 including a fastener removably secured through said intermediate portion and the furcations of said bifurcated upper end.

4. The combination of claim 3 wherein the undersurface of said intermediate portion includes a downwardly opening transverse notch formed therein in which the bottom of said bifurcated upper end portion is seatingly received.

* * * * *